US005261205A

United States Patent [19]

Sandor

[11] Patent Number: 5,261,205

[45] Date of Patent: Nov. 16, 1993

[54] METHODS AND APPARATUS FOR FABRICATING PLASTIC BLOCK PANELS

[76] Inventor: Frederick J. Sandor, 407 St. George Crt, Satellite Beach, Fla. 32937

[21] Appl. No.: 477,118

[22] Filed: Feb. 7, 1990

Related U.S. Application Data

[63] Continuation-in-part of Ser. No. 303,031, Jan. 25, 1989, abandoned, which is a continuation of Ser. No. 925,713, Oct. 30, 1986, abandoned.

[51] Int. Cl.[5] ..... E04C 2/38; E04B 2/72

[52] U.S. Cl. ..... 52/595; 52/220.2; 52/266; 52/271; 52/284; 52/588

[58] Field of Search ..... 52/220, 221, 578, 580, 52/586, 588, 595, 604, 284, 266, 270, 271

[56] References Cited

U.S. PATENT DOCUMENTS

| | | | |
|---|---|---|---|
| 1,682,414 | 8/1928 | Polacoff | 52/588 |
| 3,286,423 | 11/1966 | Donlon | 52/588 |
| 3,614,915 | 10/1971 | Perry | 52/586 |
| 3,683,576 | 8/1972 | Sikes | 52/580 |
| 3,685,222 | 8/1972 | Curtess | 52/586 |
| 3,784,312 | 1/1974 | Gordon | 52/586 |
| 3,875,714 | 4/1975 | Nayler et al. | 52/588 |
| 3,888,060 | 6/1975 | Halner | 52/589 |
| 4,058,943 | 11/1977 | Sturgill | 52/227 |
| 4,236,366 | 12/1980 | Rijnders | 52/595 |
| 4,438,614 | 3/1984 | Raith et al. | 52/580 |
| 4,557,091 | 12/1985 | Auer | 52/595 |

FOREIGN PATENT DOCUMENTS

| | | | |
|---|---|---|---|
| 2510211 | 9/1976 | Fed. Rep. of Germany | 52/595 |
| 2828769 | 1/1980 | Fed. Rep. of Germany | 52/595 |
| 334996 | 5/1971 | Sweden | 52/588 |
| 1076748 | 7/1967 | United Kingdom | 52/595 |
| 1438599 | 6/1976 | United Kingdom | 52/595 |

*Primary Examiner*—Michael Safavi
*Attorney, Agent, or Firm*—John H. Crozier

[57] ABSTRACT

Methods and apparatus are disclosed for fabricating plastic block panels suitable for use as building and construction materials. According to the invention, the panels are fabricated using a plurality of novel plastic blocks. Each block, according to the preferred embodiment of the invention, is rectangularly shaped, has broad opposite parallel surfaces (faces) and has four edges which form a closed border around the block. Two adjacent edges of each block have two laterally spaced, longitudinally extending formations thereon, each formation comprising a longitudinally extending tongue. The other two adjacent edges of each block have four laterally spaced, longitudinally extending formations thereon. Two of these formations are longitudinally extending lips, and the other two formations are longitudinally extending tongues located between said lips such that the two spaces formed between each adjacent lip and tongue are adapted to receive the two tongues on the mating edge of another block to thereby align and facilitate interconnecting the blocks. According to the preferred embodiment of the invention, the walls of each block are dimensionally equal in thickness to facilitate mass production of the block by injection molding techniques.

12 Claims, 5 Drawing Sheets

METHODS AND APPARATUS FOR FABRICATING PLASTIC BLOCK PANELS

This application is a continuation-in-part of Ser. No. 07/303,031, filed Jan. 25, 1989, now abandoned, which is a continuation of Ser. No. 06/925,713, filed Oct. 30, 1986, now abandoned.

BACKGROUND OF THE INVENTION

1. Field of the Invention

The invention relates generally to panels used for building and construction purposes and more particularly relates to panels fabricated from plastic building blocks each having edge formations used to align and interconnect adjacent blocks.

2. Description of the Related Art

Techniques for fabricating panels from building blocks to form walls, partitions, floors, ceilings and the like are well known.

One such technique is described in U.S. Pat. No. 1,682,414 issued Aug. 28, 1928 to Max Polacoff, entitled "Building Block". Polacoff's building blocks were designed to simulate brick faced walls and featured air channels between adjacent blocks. A combination of interfitting, T-shaped grooves and square shaped tongues on the edges of Polacoff's blocks are used to align the blocks and form the desired air channels.

Walls or panels fabricated using Polacoff's teachings require adhesives to interconnect the blocks. The tongue and groove arrangement taught is not used for interlocking adjacent block. Furthermore, should one desire to waterproof a panel formed by Polacoff's blocks, a sealant needs to be applied. Typically, this is accomplished by spreading a thin layer of sealant across at least one of the faces of a fully assembled panel.

Polacoff makes no controlled provisions for the acceptance of adhesives or sealants on, in or through the face of panels fabricated using his blocks. In addition, panels fabricated using Polacoff's teachings are problematic in that there are no provisions made for thermal expansion of the component blocks, sealants or adhesives.

Further yet, Polacoff does not teach how to fabricate a panel with an inherent preselected load bearing capacity, nor does he teach how his panels can be used with other building materials such as door or window frames made of dissimilar materials.

More recently, J. J. Donlon in U.S. Pat. No. 3,286,423 issued Nov. 22, 1966 entitled "Building Wall and Partition Structure", relating to building structures fabricated from blocks, went beyond Polacoff by disclosing a way to interconnect aligned blocks using mechanical components within a fabricated panel. In particular, Donlon teaches using pins to interlock adjacent blocks which are aligned using grooved edges. Notably, Donlon's disclosure requires the sliding of component block together to fabricate his panels. In addition, many of the same problems inherent in Polacoff's panels, e.g., sealant application, dealing with thermal expansion, and load variences, etc., are not solved or even addressed by Donlon.

More recent advances in fabricating panels with block are described in Nayler et al, U.S. Pat. No. 3,875,714, issued Apr. 8, 1975 entitled "Interlockable Panels"; Haener, in U.S. Pat. No. 3,888,060 issued Jun. 10, 1975 entitled "Construction Assembly and Method Including Interlocking Blocks" and Sturgill, in U.S. Pat. No. 4,058,943 issued Nov. 22, 1977 entitled "Glass Block Panel".

Nayler et al teaches the interlocking of similar panels to form a composite structure using complimentary tongues and grooves on the edges of the panels. The resultant panel assembly is tightly interconnected. As a result, the air channels shown in Polacoff, which have subsequently proved useful for installing support members and other equipment inside a panel, are lost.

Haener, focusing on blocks made of concrete, discloses blocks which are suitable for being interlocked in staggered rows to build walls, etc., without mortar joints. Haener does contemplate interconnecting cavities in the hollow block which provide space for grout to provide additional strength. However, the concrete block taught by Haener is not desirable in applications where the weight of a panel is a significant factor, nor is the block appropriate for modern day applications where light transmission through the building block is a desired feature.

Sturgill teaches fabricating panels using glass blocks each of which has circumferentially ribbed edges which fit into slotted spacers which in turn interconnect to form a rectangular framework between glass blocks capable of receiving caulking type materials to form mortar joints. Sturgill's panels do have a number of significant advantages when compared with the prior art panels fabricated using the techniques taught in the references cited herein. In particular, Sturgill's panels are lighter then concrete panels and are suitable for transmitting light. However, Sturgill's blocks, being made of glass, are subject to chip, break and shatter; are not easy to individually remove from an assembled panel and still have weight characteristics that in certain applications prove to be undesirable. Additionally, Sturgill's panels do not include the abovementioned chases for support beams, etc. and require mortar type joints for panel assembly.

None of the aforementioned patents and indeed none of the known prior art panel/building block arrangements and/or systems, are directed to using plastics, with their inherent characteristics of being lightweight and strong, for manufacturing blocks that can in turn be used to fabricate plastic panels suitable for building and construction purposes.

In addition to taking advantage of the inherent properties of plastic to fabricate the component blocks, it would be desirable to be able to manufacture such block by using modern day technology. In particular, injection molding techniques would facilitate mass production of the novel block and keep overall block and panel costs down.

It would also be advantageous to be able to produce plastic block that can be assembled, in selected applications, into plastic panels without mortar or adhesives at all. An optional snap fit or friction fit interlock for adjacent block would be desirable in these applications.

Finally, in addition to solving the aforementioned problems with prior art building block components and systems, it would be desirable to be able to fabricate plastic panels using mass producible building block components that; (1) can be varied in the manufacturing process to allow preselected amounts of light to be transmitted; (2) can be manufactured in a variety of preselected colors; (3) are durable enough to sustain transportation, handling and application stress without distortion, damage of breakage; and (4) are easy to assemble into panels and easy to remove from existing panels should "inside" panel maintenance or block replacement be desired.

SUMMARY OF THE INVENTION

Methods and apparatus are disclosed for fabricating plastic block panels suitable for use as building and construction materials.

According to the invention, the panels are fabricated using a plurality of novel plastic blocks. Each block, according to the preferred embodiment of the invention, is rectangularly shaped, has broad opposite parallel surfaces (faces) and has four edges which form a closed border around the block. Two adjacent edges of each block have two laterally spaced, longitudinally extending formations thereon, each formation comprising a longitudinally extending tongue. The other two adjacent edges of each block have four laterally spaced, longitudinally extending formations thereon. Two of these formations are longitudinally extending lips, and the other two formations are longitudinally extending tongues located between said lips such that the two spaces formed between each adjacent lip and tongue are adapted to receive the two tongues on the mating edge of another block to thereby align and facilitate interconnecting the blocks. According to the preferred embodiment of the invention, the walls of each block are dimensionally equal in thickness to facilitate mass production of the block by injection molding techniques.

Still further, according to the preferred embodiment of the invention, the plastic is a polycarbonate which may be made to exhibit any desired color and which has inherent characteristics that may be modified to permit a preselected degree of light to be transmitted by the block making up a panel.

In addition to the novel blocks, means are disclosed for assuring that panels fabricated from the blocks are compatible with other construction materials such as, for example, window and door frames.

Also, means are disclosed for providing internal panel support so that the panels are capable of supporting loads when used, for example, as walls or other load bearing surfaces. In particular, means are disclosed for providing lightweight, yet strong, I-beam type support inside a given panel. The support may be run in the smooth internal cavities (chases) formed by the interconnected plastic blocks. These panel chases are also suitable for accommodating the installation of mechanical and electrical equipment.

In addition to the above, the novel plastic blocks may be fabricated to accommodate a snap lock type or friction fit interlock to eliminate the need for sealants and/or adhesives in appropriate applications. The blocks may also be fabricated with a variety of block faces, e.g., raised, flat or recessed faces, for both asthetic and practical considerations such as providing recesses for low volatage lighting.

It is an object of the invention to provide methods and apparatus for fabricating panels out of lightweight, yet strong, building blocks where the panels, if desired, are suitable for use as walls or other load bearing surfaces.

It is a further object of the invention to provide plastic building blocks that are easy to assemble into panels comprised of aligned, interlocked blocks.

It is still a further object of the invention to provide methods and apparatus for fabricating panels out of plastic blocks that are comprised of polycarbonates and which have physical characteristics that facilitate manufacturing the block using mass production techniques such as injection molding.

It is yet another object of the invention to provide plastic block panels into which sealants and/or adhesives can be applied into controlled dimensional spaces either as the panel is being assembled or when it is completed.

Still further, it is an object of the invention to provide plastic block panels that can be assembled without mortar joints or mechanical interlocks.

Further yet, it is an object of the invention to provide plastic panels and plastic block components for assembling the panels, that are modular, durable, safe to transport, easy to handle and which become integral, reliable construction components in buildings and other structures.

The invention features panels that are capable of transmitting light to any desired degree and which can be made in any preselected color. The novel panels inherently provide for the thermal expansion of the component plastic blocks and any sealants used. Additionally, the panels are easy to assemble and/or disassemble and are compatible with other building materials and systems.

These and other objects and features of the present invention will become apparent to those skilled in the art upon consideration of the following detailed description and the accompanying Drawing, in which like reference designations represent like features throughout the figures.

BRIEF DESCRIPTION OF THE DRAWING

FIG. 5 further depicts an I-beam type support, a cable within the panel and panel trim affixed to the block to facilitate using the panel assembly in conjunction with other building materials.

DETAILED DESCRIPTION

Figure 1:
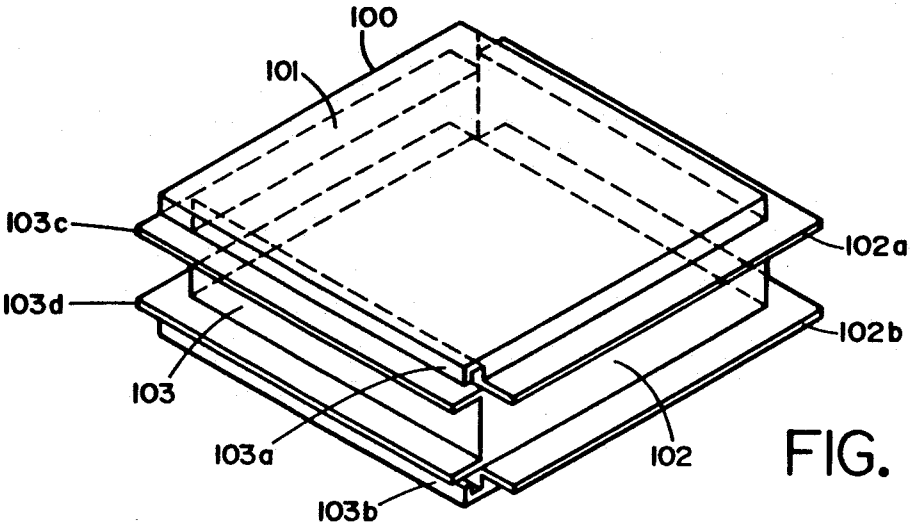
FIG. 1 depicts a partially elevated view of one embodiment of a plastic building block, fabricated in accordance with the teaching of the invention, useful as a component in a plastic block panel assembly.

FIG. 1 depicts a partially elevated view of one embodiment of a plastic block suitable for use, in accordance with the teachings herein as a component of a plastic panel assembly.

The block depicted in FIG. 1, block 100, is rectangular, and has broad opposite parallel surfaces which constitute its faces. One of the faces is labeled as face 101 in FIG. 1. The other face is hidden from view. It will become clear hereinafter that the faces of the block can be designed to meet a variety of applications and can, for example, be made raised, recessed, convex, concave, etc., as well as being the flat parallel surface depicted in FIG. 1.

Also shown in FIG. 1 are two of the 4 edges which form a closed border around the block. These are labeled as edge 102 and edge 103.

Edge 102 and the edge which is both adjacent to edge 102 and opposite edge 103 (not shown), each have two laterally spaced, longitudinally extending formations thereon, where each formation comprises a longitudinally extending tongue. These tongues are labeled on edge 102 of FIG. 1 as tongues 102*a* and 102*b*. Tongues 102*a* and 102*b* extend to the same degree and with the same lateral spacing, on the hidden edge adjacent to edge 102.

The other two adjacent edges of the block, namely edge 103 and the hidden edge opposite edge 102, have four laterally spaced, longitudinally extending formations thereon. Two of these formations, labels 103*a* and 103*b* in FIG. 1, are longitudinally extending lips. The other two formations, shown as 103*c* and 103*d* in FIG. 1, are longitudinally extending tongues located between lips 103*a* and 103*b*. The two spaces formed between each adjacent lip and tongue, i.e. the space between lip 103*a* and tongue 103*c* and the space between lip 103*b* and tongue 103*d*, are adapted to receive the two tongues (like tongues 102*a* and 102*b*) on the mating edge of another block.

Means for interconnecting, as well as aligning the blocks, are contemplated. The means for interconnecting blocks can take the form of mortarless, snap on or friction fit type interconnections. Optionally, mortar joints may be used in addition to or in lieu of the mortarless means for interconnecting block. The snap on type means for interconnecting block is depicted as part of FIG. 3 and will be described hereinafter.

It should be noted that tongues 102*a*, 102*b* 103*c* and 103*d*, lips 103*a* and 103*b*, and the counterparts of these formations on the hidden edges of the block, are preferrable of unidimensional thickness. This is not a requirement to practice the invention, but it is a desirable feature to facilitate using injection molding techniques to fabricate the blocks on a mass production basis. Other unidimensional formations, in particular, the block walls, may be seen in the preferred block design with reference to FIGS. 2 and 3 which are described hereinafter.

Figure 2:
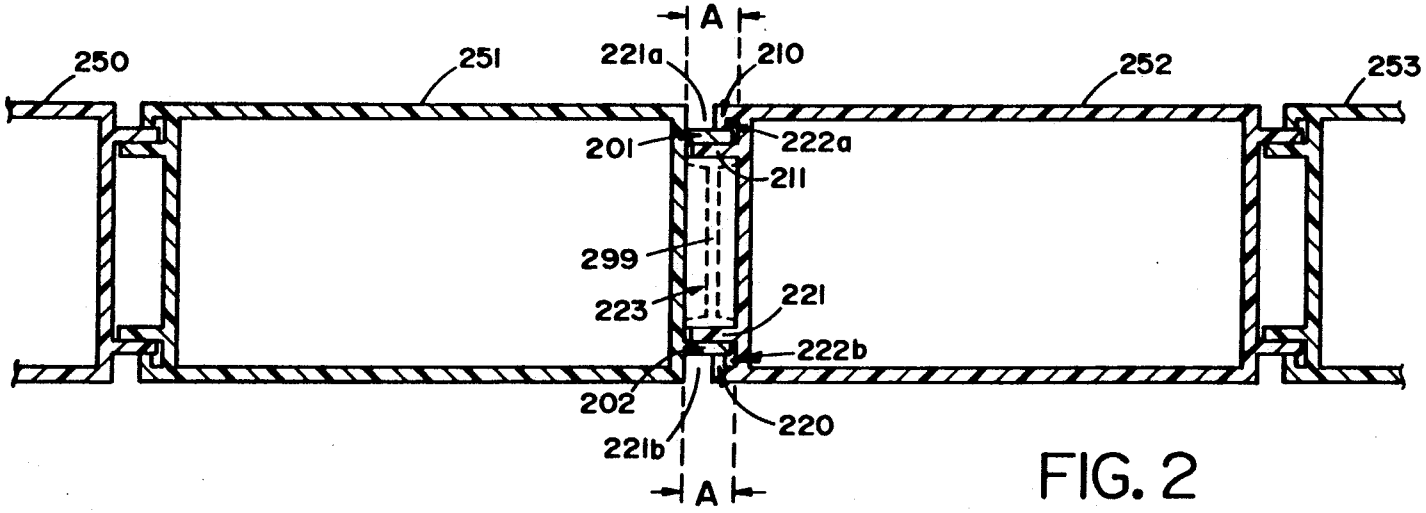
FIG. 2 depicts a simplified cutaway view of four of the plastic blocks depicted in FIG. 1, where the blocks are adjacent to one another and are interconnected in accordance with the teachings of the invention.

FIG. 2 depicts a cutaway view of four adjacent plastic blocks, block 250, 251, 252 and 253, each fabricated according to the teachings of the invention. Focusing on the section of the drawing labeled "A", the means for aligning and means for interlocking the blocks, i.e., the aforementioned tongues, lips and cavities therebetween, may be seen in detail.

In particular, tongue 201 may be seen to fit into the space between lip 210 and tongue 211; while tongue 202 may be seen to fit into the space between lip 220 and tongue 221. The spaces for receiving tongues 201 and 202 and the shape of these tongues can easily be adjusted to permit a friction type interlock between blocks. The spaces between the lip and tongue pairs which recieve the mating tongue formations also provide the required block alignment.

It should be noted with reference to FIG. 2 that the cross-section, cutaway view reveals that all walls and extensions of the blocks have a unidimensional thickness. Again, while not required, the preferred embodiment of the invention uses plastic block having this feature so that the block can be manufactured using well known injection molding techniques.

The cutaway in FIG. 2 shows cavities 221*a* and 221*b*, 222*a* and 222*b* and chase 223, all within section "A". It can be thus seen that cavities 222*a* and 222*b* are defined in part by the disposition of tongues 201 and 202 in nonabuting relationship with the left edge of adjacent block 252. Other tongues are seen also to be in nonabutting relationship with edges of adjacent blocks. The volume of the cavities can easily be adjusted by varying the extension of the depicted lips and tongues.

Cavities 221*a* and 221*b* are designed to accept controlled amounts of sealant for waterproofing a panel fabricated from the plastic blocks. Alternatively, where mortar type joints are desired, adhesive material can be placed in these cavities to interlock the blocks. A sealant may then be used over the adhesive.

According to the preferred embodiment of the invention, cavities 222*a* and 222*b* are provided to allow for thermal expansion of the blocks and/or any sealants or adhesives used in cavities 221*a* and 221*b*. Additionally, if sealants or adhesives are used between any of the depicted lips or tongues, cavities 221*a* and 221*b* will allow for thermal expansion of the blocks and/or materials on these block surfaces as well.

Chase 223 is shown to exist between the blocks 251 and 252. Actually, horizontal and vertical chases exist between each pair of blocks thereby providing a multiplicity of interior panel, horizontal and vertical chases. These may be seen clearly with reference to the panel assembly depicted in FIG. 5.

The chases, such as chase 223, are suitable for the installation of electrical and mechanical devices, e.g., telephone equipment and cables, within the panels. Also, I-beam type support can be ideally placed in the chases and will yield maximum support if tailored to fit the smooth interior surfaces of a chase. One such I-beam type support, suitable for use in the panel assembly of the invention, may be seen in dashed lines labeled 299 on FIG. 2 and may be seen in greater detail with reference to FIG. 4 which will be explained hereinafter.

Figure 3:
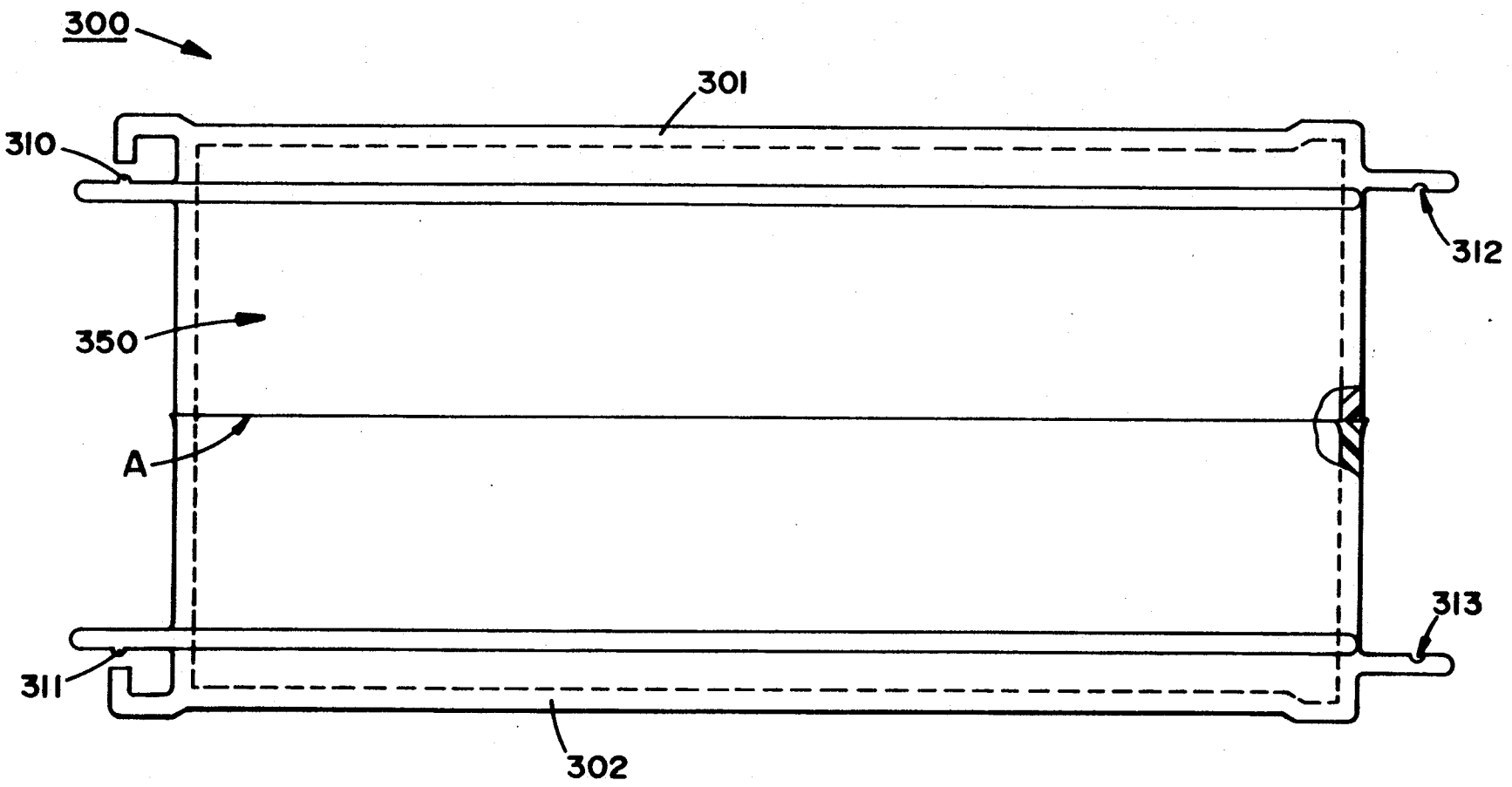
FIG. 3 depicts a detailed cutaway view of a plastic block similar to that depicted in FIG. 1, with recessed faces and with snap on interlock nubs and recesses on the tongues of the block.

FIG. 3 shows a detailed layout for a variation of the blocks shown in FIGS. 1 and 2. In FIG. 3, block 300 is shown with recessed faces 301 and 302. Also shown are snap lock nubs 310 and 311 which fit into recesses 312 and 313, respectively, of an adjacent mating block, to facilitate mortarless block interlocking. The snap locks, as shown, can be used with or without adhesives.

The FIG. 3 cutaway also depicts the unidimensional thickness of the block's walls and extended formations. It should be noted with reference to FIG. 3 that the blocks can be manufactured in half sections, each half being shown on one side of line "A", and then be fabricated by joining the block halves. Well known electrostatic welding techniques may be used to fabricate the complete block which is shown in FIG. 3 with a smooth hollow central cavity 350. The dead air in cavity 350 of each block translates into a significant insulation factor for the final panel assembly.

Obviously, cavity 350 could be filled with liquids, insulating materials, ornamental material, etc., as desired for a given application.

The dimensional thickness of the block shown in FIG. 3 is in no way meant to be a limiting factor regarding the novel block. For example, the uniform dimensional thickness depicted in FIG. 3 may be uniformly increased (so as to still be able to take advantage of injection molding), to yield block tailored for specific applications requiring a thick panel, etc.

Figure 4A:
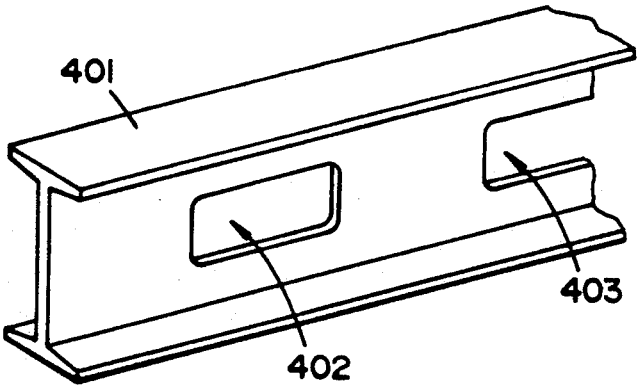
FIG. 4(A) depicts an I-beam support for panel assemblies fabricated from the plastic building blocks described herein.
Figure 4B:
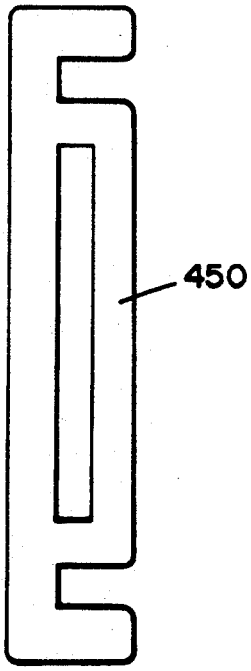
FIG. 4(B) depicts a trim cap for panel assemblies fabricated from the plastic building blocks described herein.
Figure 4C:
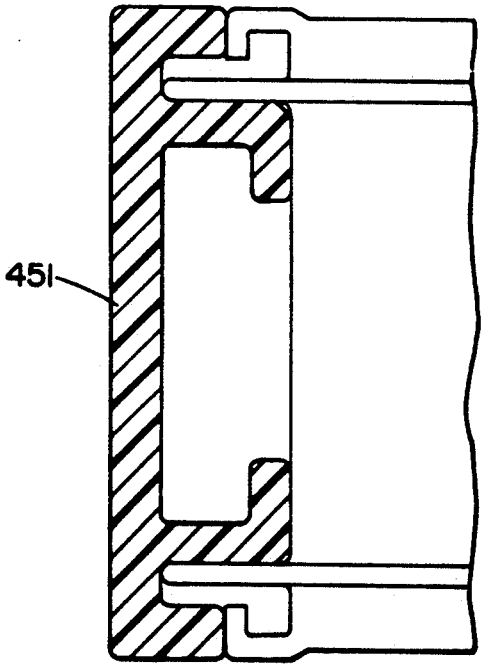
FIG. 4(C) depicts the trim cap of FIG. 4(B) installed.

FIG. 4 depicts a device that, in accordance with the preferred embodiment of the invention, may be used to provide an I-beam type support within a panel fabricated using the block disclosed herein, and two devices suitable for "trimming" a panel assembly so that it can be used in conjunction with other building and construction materials.

In particular, beam 401, shown in FIG. 4, is preferrably a molded plastic beam which can be inserted in any of the horizontal or vertical chases of a completed panel. The cutout portions of beam 401, shown as 402 and 403 in FIG. 4, allow for the continuity of any chases the beam intersects. The beam is optionally designed to fit snugly in the smooth cavity of a given chase to take maximum advantage of its strengthening potential.

In addition to plastic, the I-beam type support described can be made of any desired material which would lend strength to the panel. It should be obvious to those skilled in the art, that the use of beams, such as beam 401, will permit the panels fabricated from the blocks described herein, to be used as walls or other load bearing surfaces.

Also shown in FIG. 4 are devices 450 and 451 which, according to the preferred embodiment of the invention, are plastic caps or "trim" type molding which cover the edge formations on the sides of a panel and/or the edge formations on any opening(s) in a panel and which may be held in place by means of an adhesive or similar material (none shone). Devices 450 and 451 are also preferrably designed to be modular and of sufficient breadth and thickness to receive dissimilar building and construction materials within panel openings and/or along panel borders. It can be thus seen that devices 450 and 451 are attached to the end of a block without the use of mechanical fasteners.

Device 450 is the cap for a two formation block (or panel) edge while device 451 is the cap for a four formation block (or panel) edge. Although the preferred embodiment of caps 450 and 451 is the design shown in FIG. 4 implemented in plastic, the caps for the novel blocks and panel assemblies disclosed herein are not intended to be limited in form or material content.

Figure 5:
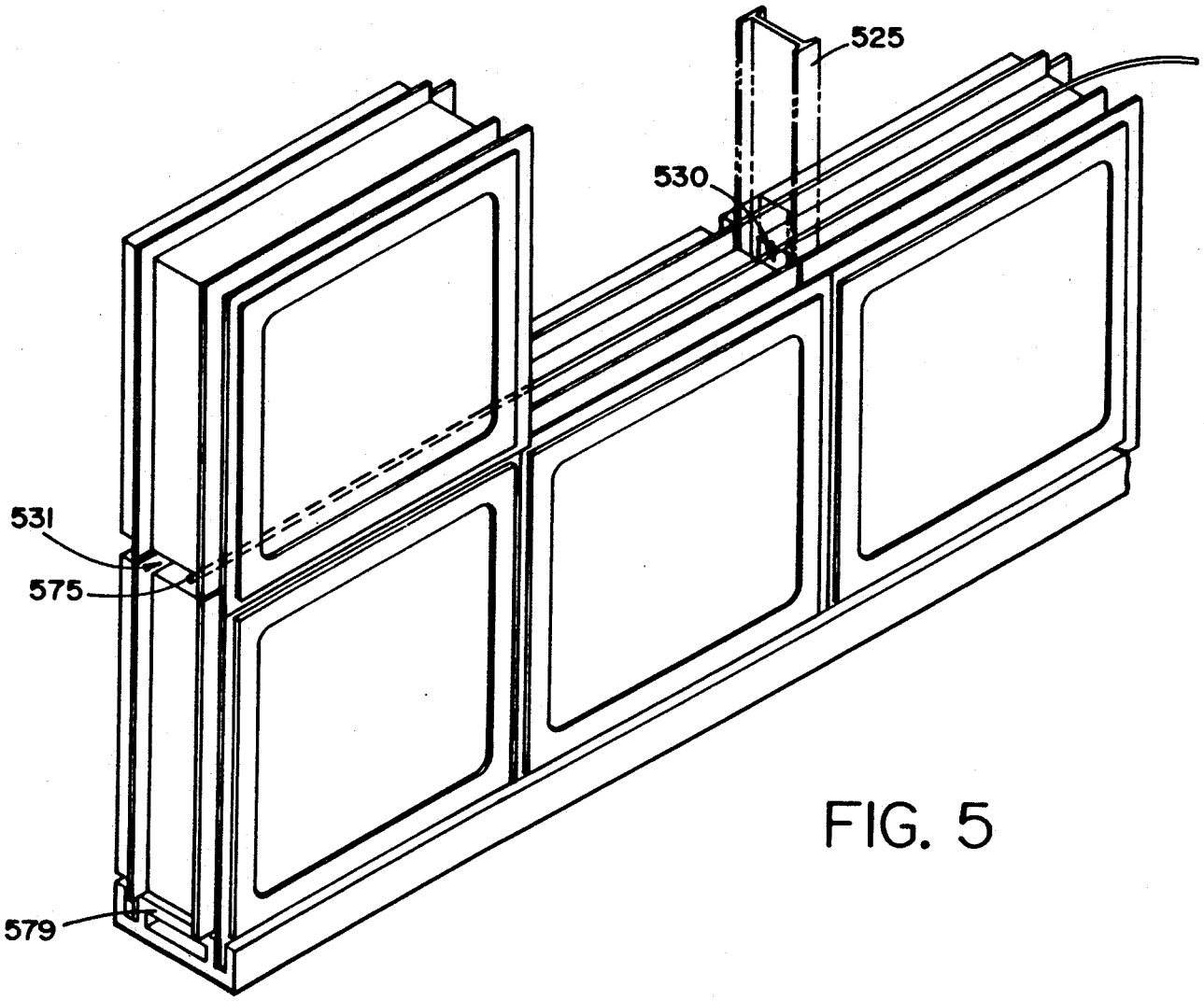
FIG. 5 depicts a complete plastic panel assembly fabricated using the plastic blocks depicted in FIG. 1.

FIG. 5 depicts a complete plastic panel assembly fabricated using a plurality of plastic blocks, each like block 300 of FIG. 3. FIG. 5 further depicts an I-beam type support 525 running inside of chase 530 which runs vertically in the depicted panel. Also shown in FIG. 5 are cable 575 running within chase 531, and panel trim molding 579 on the base of the panel. The molding is such that a frame for a door, window, etc. may be laid against the base of the depicted panel.

Figure 6:
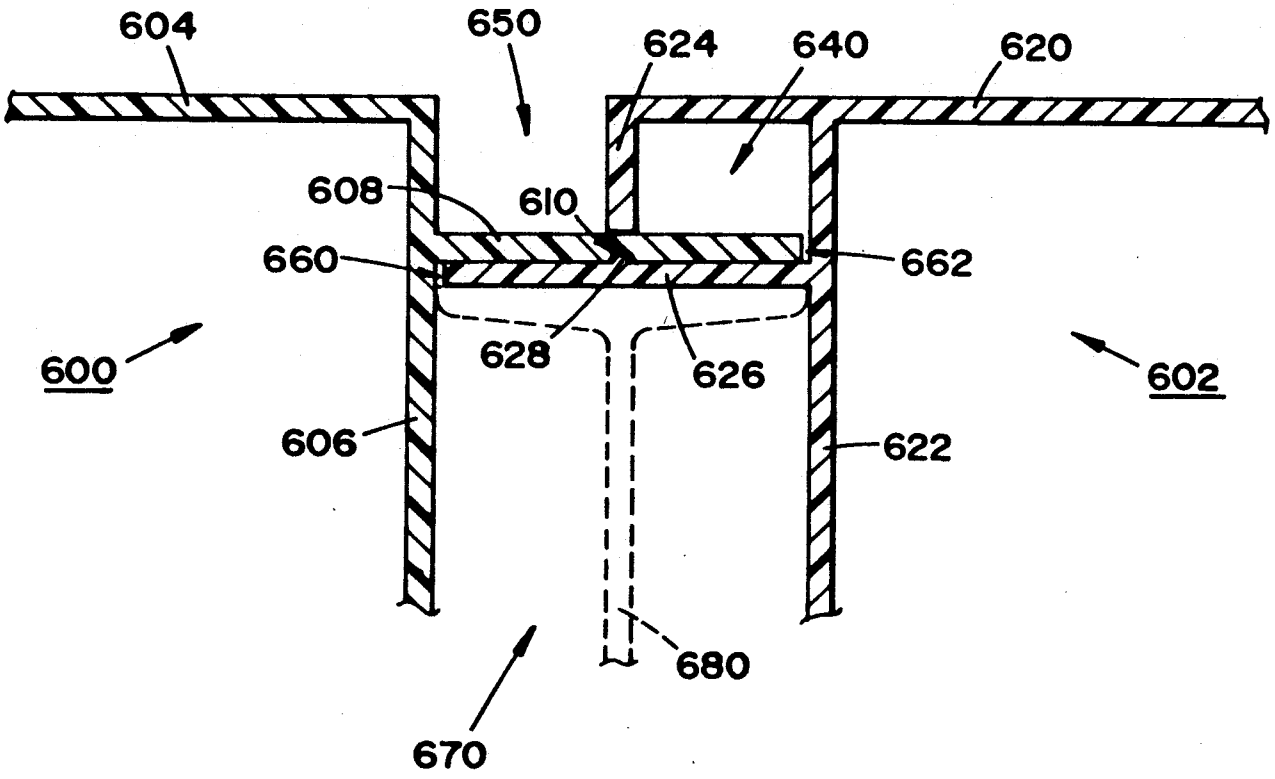
FIG. 6 is an enlarged, fragmentary, cutaway view of two adjacent plastic blocks depicting the relationship of interlock nubs and recesses and overlapping tongues.

FIG. 6 depicts how the snap locks of the present invention are used to join adjacent plastic blocks, here, blocks generally indicated by the reference numerals 600 and 602. Block 600 includes a face panel 604, and end panel 606, and a tongue 608 extending exteriorly from the end panel. Defined in the inner face of tongue 608 is a recess 610. Block 602 includes a face panel 620 and an end panel 622. Formed as an extension of face panel 620 is an inward facing lip 624 and extending exteriorly from end panel 622 is a tongue 626. Formed on the outer face of tongue 622 is a raised nub 628 which is loosely cooperatively engaged by recess 610 in tongue 608. As described above, the thicknesses of the elements of blocks 600 and 602, apart from recess 610 and nub 628, are preferably unidimensional and each block is preferably molded.

It can be understood from an inspection of FIG. 6, that blocks 600 and 602 have been assembled by initially engaging the ends of tongues 608 and 626, sliding the blocks toward each other so that the distal end of tongue 608 engages the end of lip 624 forcing the lip slightly outward, and continuing to advance the blocks toward each other until recess 610 and nub 628 snap together. Cavity 640 defined by tongue 608, end panel 622, and lip 624 may now be filled with a sealant and/or adhesive or other material (none shown) as discussed above. Likewise, the gap 650 defined by end panel 606, tongue 608 and lip 624 may now be filled.

An important aspect of the present invention can be seen on FIG. 6, wherein, when blocks 600 andd 602 are snapped together, gaps 660 and 662, respectively, are defined between end panel 606 and the distal end of tongue 626 and between end panel 622 and the distal end of tongue 608. Thus, blocks 600 and 602 are in nonabutting axial relationship. Likewise, recess 610 defines a gap around nub 628. Gaps 660 and 662 and the gap around nub 628 are small enough that blocks 600 and 602 are held together relatively rigidly, but are large enough to allow for thermal expansion of the blocks, without which gaps the wall of which the blocks are a part would buckle when exposed to an increase in temperature.

When the unidimensional thicknesses of the elements of blocks 600 and 602 is on the order of about 0.125 inch, gaps 660 and 662 are preferably on the order of about 0.030 inch and recess 610 preferably has a radius on the order of about 0.055 inch with nub 628 having a radius on the order of about 0.040 inch. Referring further to FIG. 6, there is shown in a chase 670 defined between blocks 600 and 602 an I-beam support member 680, the upper end of which member bears against the inner face of tongue 626. Since the inner face of tongue 626 provides a planar surface extending between end panels 606 and 622, which surface is parallel with face panels 604 and 620, support member 680 furnishes a high degree of rigidity to the wall of which blocks 600 and 602 are a part.

It will be understood that members comprising a mirror image of the fragment shown on FIG. 6 will be provided at the other end of chase 670.

What has been described in detail hereinbefore is the structure of novel plastic blocks and various panel components from which panel assemblies suitable for building and construction purposes can be easily and cost effectively produced and assembled.

One of ordinary skill in the art will readily appreciate that commercially available plastics, in particular polycarbonates, such as the LEXAN® (a trademark of General Electric Corporation), are well adapted to injection molding processes and may be used to fabricate the blocks and panel components described herein.

LEXAN in particular, according to the preferred embodiment of the invention, is an excellent material from which to fabricate the block. Methods and processes for varying LEXAN's light transmitting characteristics, its color, and thermal energy resistance are well known. In addition, sealants comprised of silicon or urethane are known which adhere well to LEXAN providing excellent means to waterproof panels made from LEXAN blocks.

Finally, it should be apparent that the blocks used to fabricate the plastic panels described herein can easily be removed for replacement or for access to the internal chases of a panel. For example, if the joints between blocks are mortarless, such as the snap on type interlock shown in FIG. 3, the height of the nubs and depths of the recesses shown in FIG. 3 can easily be adjusted to permit disassembly by a preselected amount of force being applied to a given block. Obviously, if mortar is used in the cavities extending to the panels face, it can be removed to facilitate block disassembly, etc.

Many permeations of block color, block insulating qualities, mortar or sealant options, block and panel strengths, durability, etc. are all possible using the teachings of the invention as set forth herein.

What has been described are methods and apparatus for fabricating plastic block panels using the novel plastic building blocks and panel components taught herein. These methods and apparatus meet the objectives set forth hereinbefore.

The foregoing description of a preferred embodiment of the novel methods and apparatus has been presented for the purposes of illustration and description only. It is not intended to be exhaustive or to limit the invention to the precise form disclosed, and obviously many modifications and variations are possible in light of the above teaching.

For example, the plastic blocks which are preferrably rectangular, can be manufactured in a variety of shapes, such as octagonal, triangular, etc., with variations in the formations on the edges to provide for the mating with adjacent block, a variety of chase paths, a variety of shaped sealant and expansion cavaties, etc., without departing from the scope or spirit of the invention. Accessories, such as aluminum extrusions which may be placed between the interfitting tongues and grooves of the blocks described herein, to provide extra support, rigidity, etc., may also be used in conjunction with the invention without departing from its scope or spirit.

The embodiment and examples set forth herein were presented in order to best explain the principles of the instant invention and its practical application to thereby enable others skilled in the art to best utilize the instant invention in various embodiments and with various modifications as are suited to the particular use contemplated.

It is intended that the scope of the instant invention be defined by the claims appended hereto.

What is claimed is:

1. A plastic block panel assembly comprising a plurality of edge interfitting selfaligning plastic blocks, said blocks having opposite parallel faces and end panels orthogonal to and extending between said faces, said blocks being interconnected to form the assembly and provide walled horizontal and vertical chases within said assembly wherein at least two chase walls parallel to said faces and extending between said end panels provide planar surfaces between said end panels against which planar surfaces a load bearing support member may be placed; means for retaining applied sealants and adhesives between said plurality of blocks and; and means for permitting thermal expansion of said blocks, sealants and adhesives.

2. An assembly as set forth in claim 1 wherein said means for retaining includes at least one dimensionally controlled cavity between two adjacent ones of said plurality of interconnected blocks.

3. An assembly as set forth in claim 1 wherein said means for permitting thermal expansion includes at least one dimensionally controlled cavity between two adjacent ones of said plurality of interconnected blocks.

4. An assembly as set forth in claim 1 further comprising at least one reinforcing member of I-beam form located in at least one of said chases and extending between said parallel walls.

5. An assembly as set forth in claim 1 wherein each of said plurality of blocks is comprises entirely of unidimensionally thick elements.

6. An assembly as set forth in claim 1 wherein each of said blocks is rectangularly shaped, has broad opposite parallel surfaces (faces), and has four edges which form a closed border around each block; wherein each of said blocks has two adjacent mating edges each having two laterally spaced, longitudinally extending formations thereon, each formation comprising a longitudinally extending tongue and further wherein the edges of each block opposite said mating edges, each have four laterally spaced, longitudinally extending formations thereon where two of these four formations are longitudinally extending lips, and the other two of these four formations are longitudinally extending tongues, located between said lips, such that spaces are formed between each adjacent lip and tongue that are adapted to receive the two tongues on either mating edge of another of said plurality of blocks to thereby align and facilitate interconnecting said block; and wherein each of said plurality of blocks is comprised entirely of unidimensionally thick elements.

7. A plastic block panel assembly comprising:

(a) a plurality of edge interfitting selfaligning plastic blocks, said blocks having opposite parallel faces and being interconnected to form the assembly and provided walled horizontal and vertical chases within said assembly wherein at least two chase walls parallel to said faces provide substantially planar surfaces against which a load bearing support member may be placed;

(b) means for retaining applied sealants and adhesives between said plurality of blocks wherein said means for retaining further comprises at least one dimensionally controlled cavity between two adjacent ones of said plurality of interconnected blocks; and (c) means for permitting thermal expansion of said blocks, sealant and adhesives which includes at least one dimensionally controlled cavity between two adjacent ones of said plurality of interconnected blocks.

8. An assembly as set forth in claim 7 further comprising at least one reinforcing member of I-beam form located in at least one of said chases and extending between said parallel walls.

9. An assembly as set forth in claim 7 where each of said plurality of blocks is comprised entirely of unidimensionally thick elements.

10. A modular plastic building block comprising a rectangularly shaped body portion, broad opposite parallel surfaces (faces), and four edges which form a closed border around said body portion, wherein two adjacent mating edges of said body have two laterally spaced, longitudinally extending formations thereon, each formation comprising a longitudinally extending tongue and further wherein the edges of said body opposite said mating edges have four laterally spaced, longitudinally extending formations thereon where two of these four formations are longitudinally extending lips, and the other two of these four formations are longitudinally extending tongues, located between said lips, such that spaces are formed between each adjacent lip and tongue that are adapted to receive the two tongues on either mating edge of the body of another modular block, in nonabutting axial relationship, to thereby align and facilitate interconnecting said blocks and to provide spaces between the ends of said tongues of said modular building block and the mating edge of the body of said another modular block to allow for thermal expansion of said blocks.

11. A modular plastic building block as set forth in claim 10 wherein said plastic is a polycarbonate.

12. A modular plastic building block as set forth in claim 10 where said block is further comprised entirely of unidimensionally thick elements.

* * * * *